US007680437B2

(12) United States Patent
Schneider et al.

(10) Patent No.: US 7,680,437 B2
(45) Date of Patent: Mar. 16, 2010

(54) APPARATUS AND METHOD FOR DRIVING A MACHINE IN A REPLACEABLE CARTRIDGE

(76) Inventors: Avner Schneider, 10 S Kiryat Weizmann S, Ness Ziona Rehovot 76101 (IL); Pini Harzuf, 10 S Kiryat Weizmann S, Ness Ziona Rehovot 76101 (IL); Ilan Frydman, 10 S Kiryat Weizmann S, Ness Ziona Rehovot 76101 (IL)

( * ) Notice: Subject to any disclaimer, the term of this patent is extended or adjusted under 35 U.S.C. 154(b) by 186 days.

(21) Appl. No.: 11/740,741

(22) Filed: Apr. 26, 2007

(65) Prior Publication Data

US 2008/0267660 A1 Oct. 30, 2008

(51) Int. Cl.
*G03G 15/04* (2006.01)
*G03G 15/00* (2006.01)

(52) U.S. Cl. ..... 399/119; 399/167

(58) Field of Classification Search ..... 399/119, 399/167; 464/169, 182, 32, 33
See application file for complete search history.

(56) References Cited

U.S. PATENT DOCUMENTS 4,615,605 A * 10/1986 Kida et al. ..... 399/113
4,835,565 A * 5/1989 Nagatsuna et al. ..... 399/119
5,920,753 A * 7/1999 Sasaki et al. ..... 399/111
7,155,145 B2 * 12/2006 Iwasaki et al. ..... 399/167
2003/0215265 A1 * 11/2003 Kawai ..... 399/167
2005/0111882 A1 * 5/2005 Sudo et al. ..... 399/222
2006/0029435 A1 * 2/2006 Kasai et al. ..... 399/267
2006/0222405 A1 * 10/2006 Iwasaki ..... 399/167

* cited by examiner

*Primary Examiner*—David M Gray
*Assistant Examiner*—Rodney Bonnette

(57) ABSTRACT

An apparatus for driving a machine in a replaceable cartridge supporting a first rotatable element for transferring rotary motion to the machine includes a housing for accommodating the cartridge at a pre-determined position. The housing supports a second rotatable element. A locking mechanism includes a component, provided on a certain one of the first and second rotatable elements, capable of assuming a state of readiness in which, with the cartridge at the pre-determined position, the component is positioned relative to the other rotatable element such that, upon rotation of the second rotatable element in at least one direction, the first rotatable element rotates with the second rotatable element, and in which state the rotatable elements are axially decoupled. The certain one of the first and second rotatable elements is provided with a mechanism for exerting a torque on the component tending to establish the state of readiness.

28 Claims, 5 Drawing Sheets

APPARATUS AND METHOD FOR DRIVING A MACHINE IN A REPLACEABLE CARTRIDGE

FIELD OF THE INVENTION

The invention relates to an apparatus for driving a machine in a replaceable cartridge, the cartridge supporting a first rotatable element for transferring rotary motion to the machine, wherein the apparatus includes:

a housing for accommodating the cartridge at a pre-determined position;

a second rotatable element, supported in the housing; and a locking mechanism, including a component, provided on a certain one of the first and second rotatable elements, and capable of assuming a state of readiness in which, with the cartridge at the pre-determined position, the component is positioned relative to the other of the rotatable elements such that, upon rotation of the second rotatable element in at least a first direction, the first rotatable element rotates with the second rotatable element, and in which state the first and second rotatable elements are axially decoupled.

The invention also relates to a method of driving a machine in a replaceable cartridge supporting a first rotatable element for driving the machine, which method includes:

providing a housing for accommodating the cartridge at a pre-determined position, the housing including a second rotatable element, wherein a component of a locking mechanism is provided on one of the first and second rotatable elements;

placing the component in a state of readiness, in which state the component is positioned relative to the other of the rotatable elements such that, upon rotation of the second rotatable element in at least a first direction, the first rotatable element rotates with the second rotatable element, and in which state the first and second rotatable elements are axially decoupled.

BACKGROUND ART

Replaceable cartridges including machinery driven by a rotatable element are to be found, for example, in printer apparatus. In some types of electrophotographic printing apparatus, a replaceable binary ink dispersion cartridge (BID cartridge) is used to transfer toner to an electrostatically charged drum carrying a latent electrostatic image. The BID cartridge contains a mechanism for stirring the toner, in order to apply it homogeneously to the drum. In other embodiments of electrophotographic printing apparatus, the drum is comprised in the same cartridge as the toner. In that case, there is also a mechanism for rotating the drum.

The cartridge is replaceable because it contains components that wear out quickly and/or are consumed. When a new cartridge has been inserted into the apparatus, a so-called "soft start" is generally necessary. This is a method of driving the mechanism in the cartridge using an external drive according to particular characteristic programmed in the external drive control system. Generally, it involves driving the cartridge at a lower speed, allowing a component on a driven shaft to align correctly with a component on a shaft of the cartridge so that the two can engage to assume a state of readiness for driving at normal operating speeds. The soft start routines therefore involve a control system with a relatively elaborate and complicated implementation to effect this alignment.

It would, alternatively, be possible to engage a shaft of the cartridge by means of a clamping mechanism or some other kind of friction fit. This, however, makes removal of the cartridge more difficult, since such a connection would also lock the shaft in position in an axial direction (i.e. in a direction parallel to its rotation), the direction coinciding generally with the direction in which the cartridge is inserted in and withdrawn from the apparatus's housing.

DISCLOSURE OF THE INVENTION

The invention provides an apparatus, method and printing apparatus that allow for ready release of the first rotatable element after use, as well as easy placement of a new cartridge in the housing and a subsequent "hard start". By this latter characteristic is meant that, after placement of the cartridge at a pre-determined position, the second rotatable element can be driven at operating speed from the start.

This is achieved by the apparatus according to the invention, in which the certain one of the first and second rotatable elements is provided with a mechanism for exerting a torque on the component tending to establish the state of readiness.

The mechanism for exerting a torque on the component tending to establish the state of readiness removes the necessity for special routines for driving the second rotatable elements in order to establish the state of readiness, or to release the lock of the component on the first rotatable element after use. A hard start is possible from the state of readiness, since, in this state, the component is positioned relative to the other of the rotatable elements such that, upon rotation of the second rotatable element in at least a first direction, the first rotatable element rotates with the second rotatable element. The state of readiness also allows ready release of the first rotatable element after use.

In an embodiment, the locking mechanism is arranged such that the first rotatable element rotates with the second rotatable element only upon rotation of the second rotatable element in one of two opposite senses.

Thus, it is not necessary to control or regulate the application of a lock in tangential direction separately. The lock is applied automatically when required, namely when the second rotatable element is driven by a motor in a particular sense.

In an embodiment, the mechanism for exerting a torque includes resilient means, arranged to exert a force providing the torque.

An effect is that a separate actuator to energise the transition to the state of readiness is not required.

In an embodiment, the locking mechanism is actuated by transfer of rotary energy from the second rotatable element to effect at least one of establishment and release of the lock.

An effect is that a separate actuator to energise the application of the tangential lock is not required. The motor driving the second rotatable element also energises (at least indirectly) the locking mechanism.

In an embodiment, the locking mechanism includes a part, coupled to a shaft of one of the first and second rotatable elements by means of a flexible coupling, and arranged to engage a part of the other of the first and second rotatable elements.

An effect is that slight misalignments of the axes of rotation of the first and second rotatable elements are absorbed by the flexible coupling.

In an embodiment, the first rotatable element includes a shaft protruding from the cartridge and the component of the locking mechanism is connected to the second rotatable element and arranged to clamp the shaft.

An effect is that the cartridge is simpler, and can thus be made more cheaply. The interface to the second rotatable element is not dependent on specially machined or moulded parts, at least on the cartridge-side.

In another embodiment, the locking mechanism includes mutually interlocking parts, wherein a first of the mutually interlocking parts is provided on the component of the locking mechanism, and the other of the first and second rotatable elements is provided with a second of the mutually interlocking parts.

An effect is to minimise slip between the first and second rotatable elements. Transfer of rotary motion is thus carried out relatively efficiently.

In an embodiment, the component of the locking mechanism is moveable, at least to a limited extent, in an axial direction relative to the one of the first and second rotatable elements.

An effect is that engagement and disengagement of the first and second rotatable elements is effected by axial displacement of the at least one of the mutually interlocking parts, even where the cartridge is at its pre-determined position. To release the lock, the interlocking part(s) are retracted, freeing an end part of the first rotatable element. This makes easy removal of the cartridge possible.

In another embodiment, the mechanism for exerting a torque is arranged to cause at least the first of the interlocking parts to rotate with respect to the certain one of the rotatable elements, at least when disengaged from the second of the mutually interlocking parts.

An effect is to enable the use of interlocking parts that require alignment, without having to rotate either of the first and second rotatable elements to effect the alignment.

According to another aspect of the invention, there is provided a method of driving a machine in a replaceable cartridge supporting a first rotatable element for driving the machine, which method includes.

providing a housing for accommodating the cartridge at a pre-determined position, the housing including a second rotatable element, wherein a component of a locking mechanism is provided on one of the first and second rotatable elements; and placing the component in a state of readiness, in which state the component is positioned relative to the other of the rotatable elements such that, upon rotation of the second rotatable element in at least a first direction, the first rotatable element rotates with the second rotatable element, and in which state the first and second rotatable elements are axially decoupled, wherein the component is placed in the state of readiness by rotating at least a part of the component relative to the one of the first and second rotatable elements.

According to another aspect of the invention, there is provided a printing apparatus comprising an apparatus for driving a machine in a replaceable cartridge according to the invention.

BRIEF DESCRIPTION OF THE DRAWINGS

The invention will now be explained in further detail with reference to the accompanying drawings, in which.

DETAILED DESCRIPTION

Figure 1:
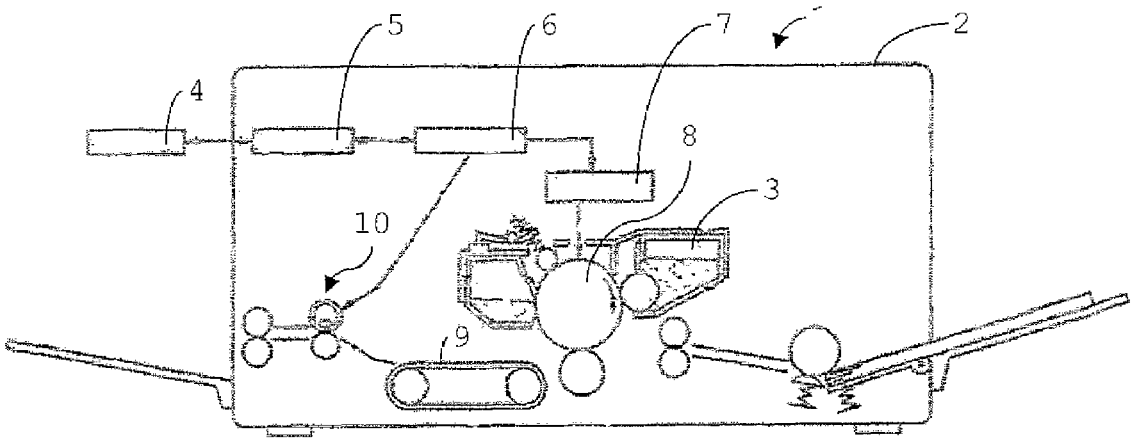
FIG. 1 is a schematic diagram of a first embodiment of a printing apparatus including a toner cartridge.

An electrophotographic printer 1 includes a housing 2 and a toner cartridge 3. The toner cartridge 3 is removeable from the housing 2 and replaceable. A guide mechanism (not shown) is provided for positioning the toner cartridge 3 at a pre-determined position relative to the housing 2. The toner cartridge 3 includes a machine for agitating the toner and transferring it. The machine is driven by drive means provided in the housing 2.

A computer 4 is arranged to send print data to a formatter 5. The formatter 5 converts the print data into a stream of binary print data. The binary print data is sent to a controller 6, which controls the operation of the printer 1. In particular, it controls the operation of a scanner 7. The scanner includes a laser device (not shown) for selectively removing charge from an electrostatically charged photoconductor drum 8. Toner is transferred from the toner cartridge 3 to the photoconductor drum 8 to form a latent image, which is transferred to paper. A transport mechanism 9 transfers the paper to a fuser 10. The fuser 10 is arranged to fix the image transferred to the paper from the photoconductor drum 8 through the application of heat and/or pressure.

Figure 2:
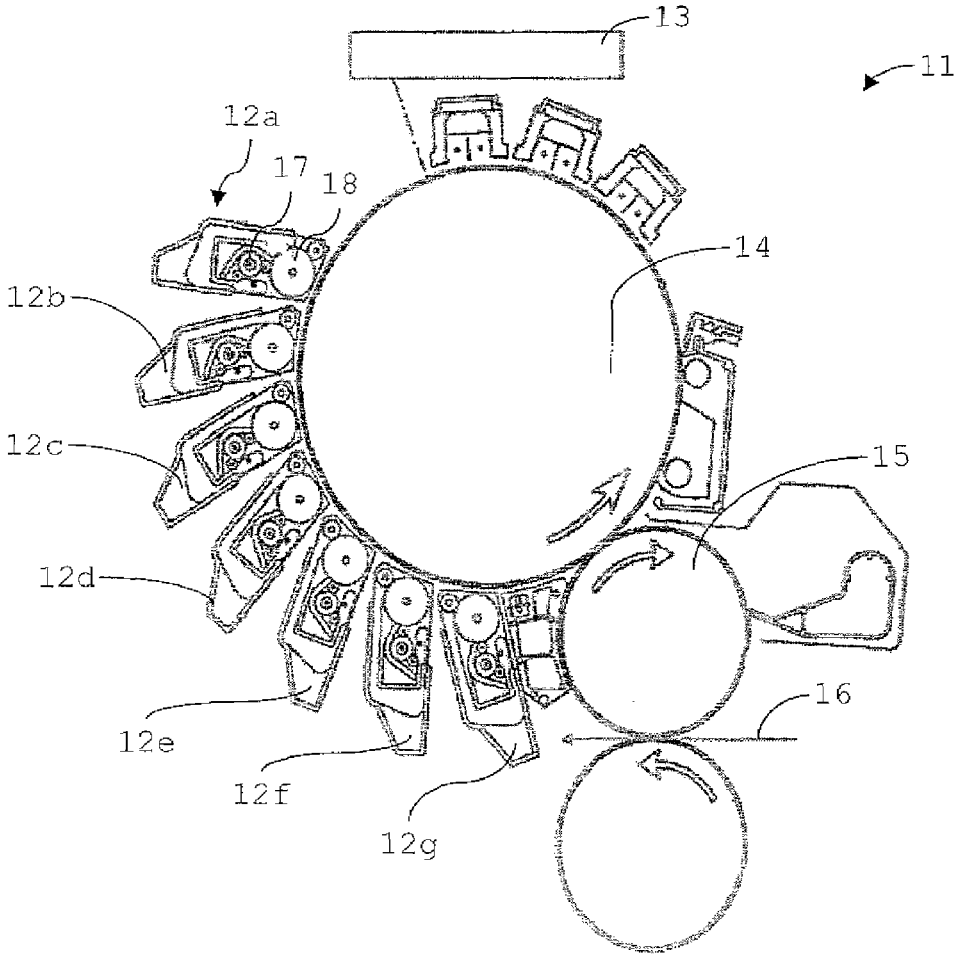
FIG. 2 is a schematic diagram of a second embodiment of a printing apparatus including a plurality of binary ink dispersion cartridges.

An industrial printer 11 is illustrated in FIG. 2. It operates according to a similar principle, except that it includes a plurality of Binary Ink Dispersion (BID) cartridges 12. In operation, a scanner 13 discharges an electrostatically charged photoconductive drum 14, to form a latent image thereon. The BID cartridges 12 transfer developed ink to the uncharged areas. The image is transferred via a heated and charged second drum 15 onto a sheet 16. The BID cartridges 12 are replaceable and comprise a machine 17 to agitate the ink and to drive a rotating developer 18. The machine 17 is driven by a first rotatable element (not shown in detail), which in turn is connectable to a second rotatable element (not shown) supported by a housing of the industrial printer 11. Each rotatable element used to drive a corresponding rotatable element of one of the BID cartridges 12, can be driven individually by an associated electric motor. Alternatively, a central drive system with a series of drive belts can be used.

The BID cartridges 12 are accommodated at pre-determined positions relative to the housing of the industrial printer 11. They require replacement at relatively frequent intervals, whenever the supply of ink is exhausted or mechanical parts such as those comprised in the machine 17 or developer 18 become worn. The interface between the first rotatable element and the second rotatable element is such that, upon replacement of one of the BID cartridges 12, the new BID cartridge 12 can be driven immediately at its intended operating speed. This avoids the need to execute a special routine after each replacement of a BID cartridge 12.

Figure 3:
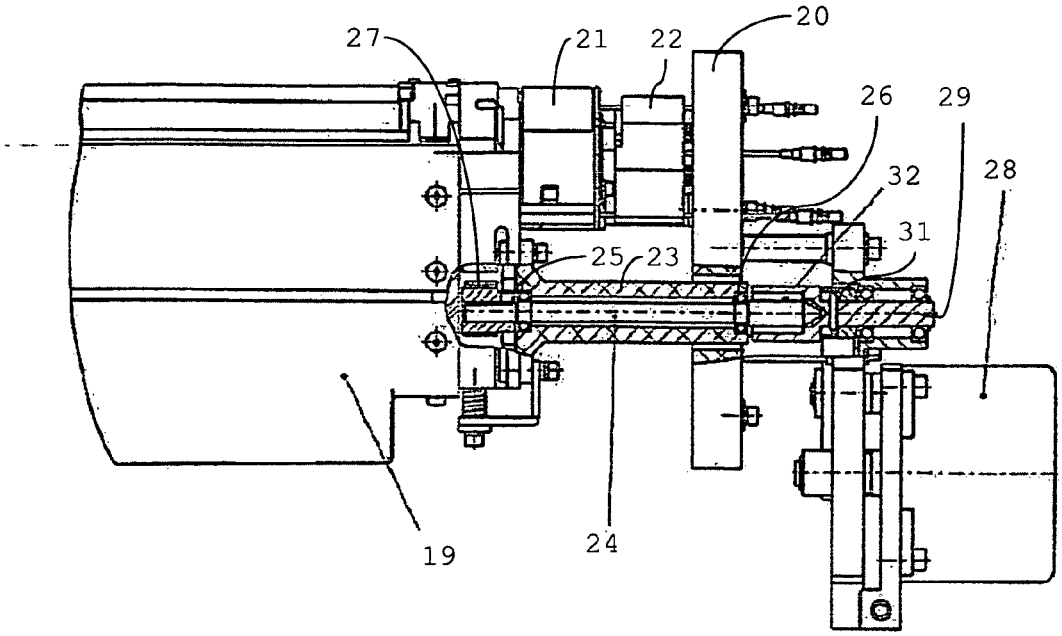
FIG. 3 is a cross-sectional view of a first embodiment of an interface between a replaceable cartridge and a printer housing.
Figure 4:
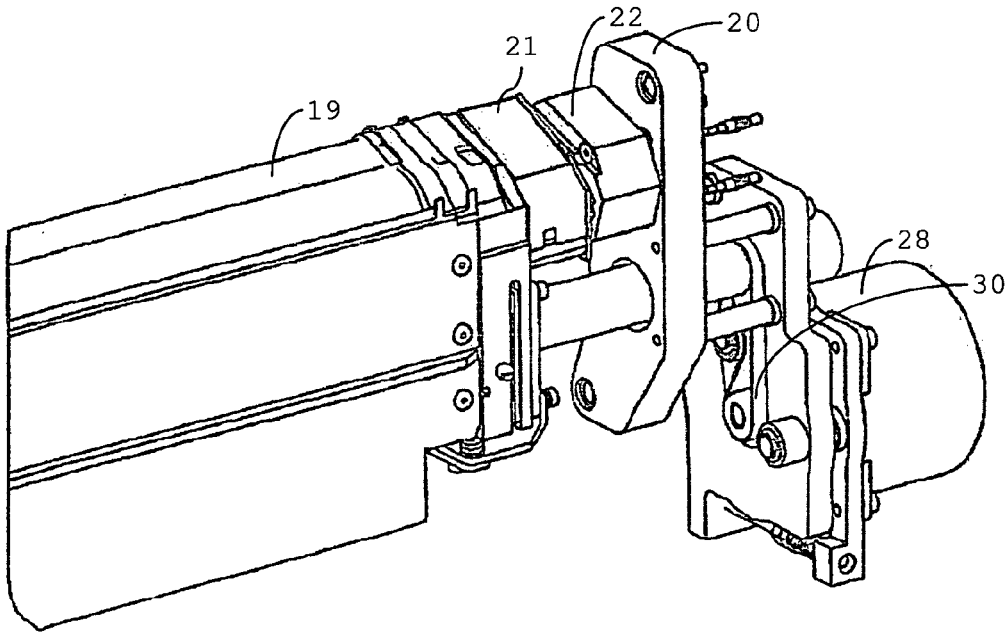
FIG. 4 is a perspective view of the interface of FIG. 3.
Figure 5:
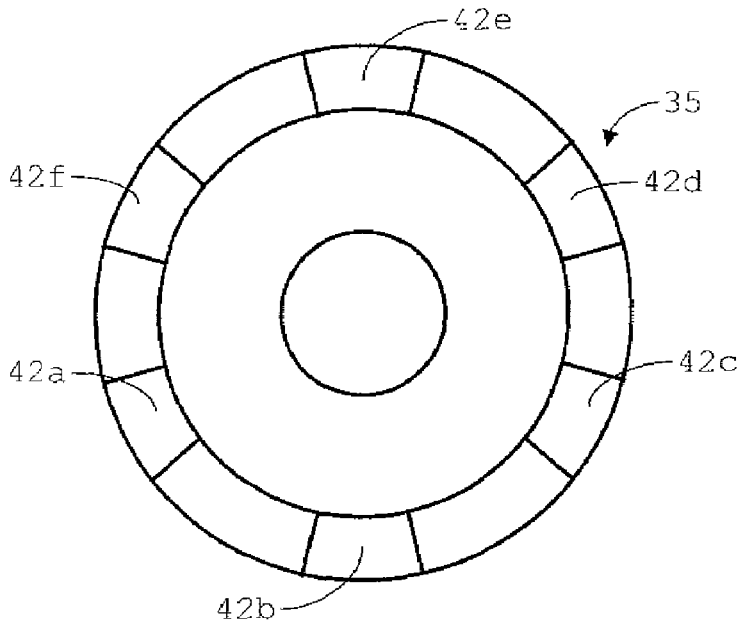
FIG. 5 is a schematic top view of a first component of a second embodiment of an interface between a shaft of a binary ink dispersion cartridge and a shaft of a printer.
Figure 6:
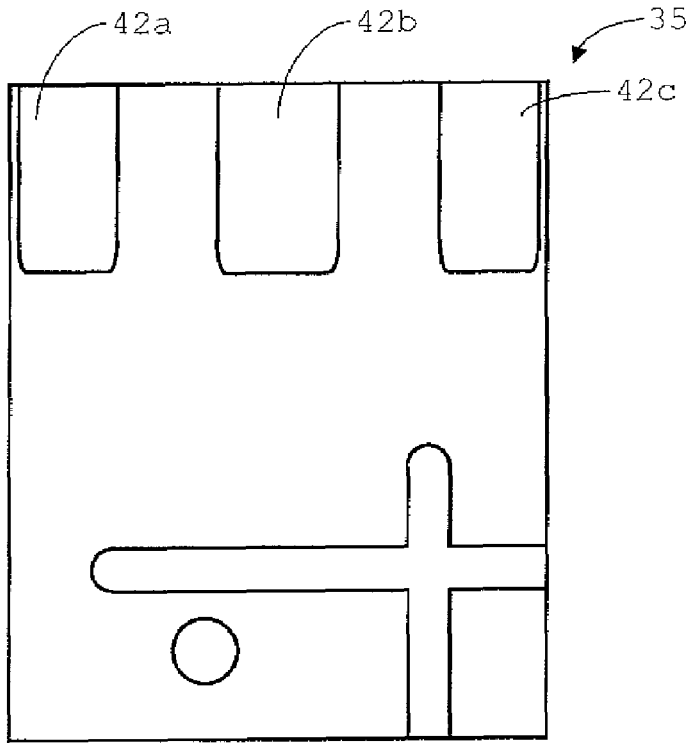
FIG. 6 is a schematic view in side-elevation of the component of FIG. 5.
Figure 7:
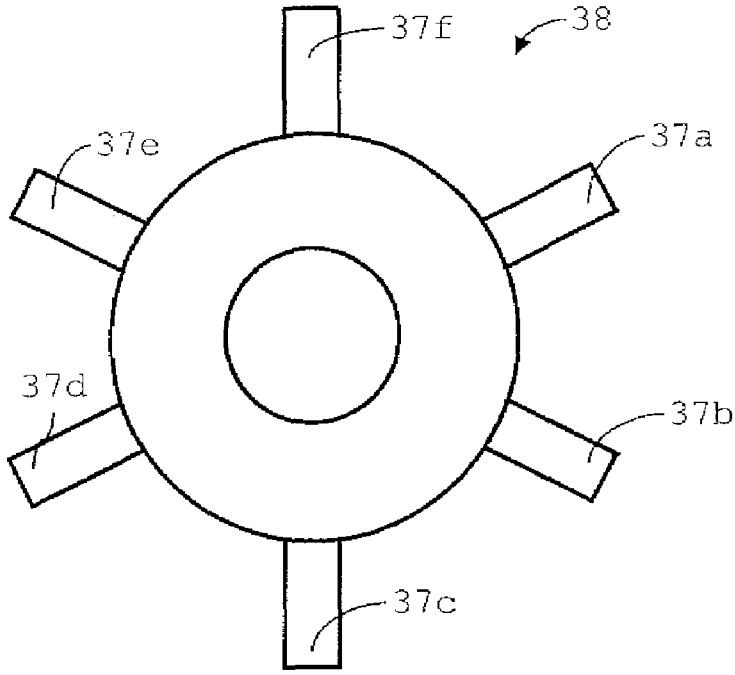
FIG. 7 is a schematic top view of a second component of the second interface of FIG. 5.
Figure 8:
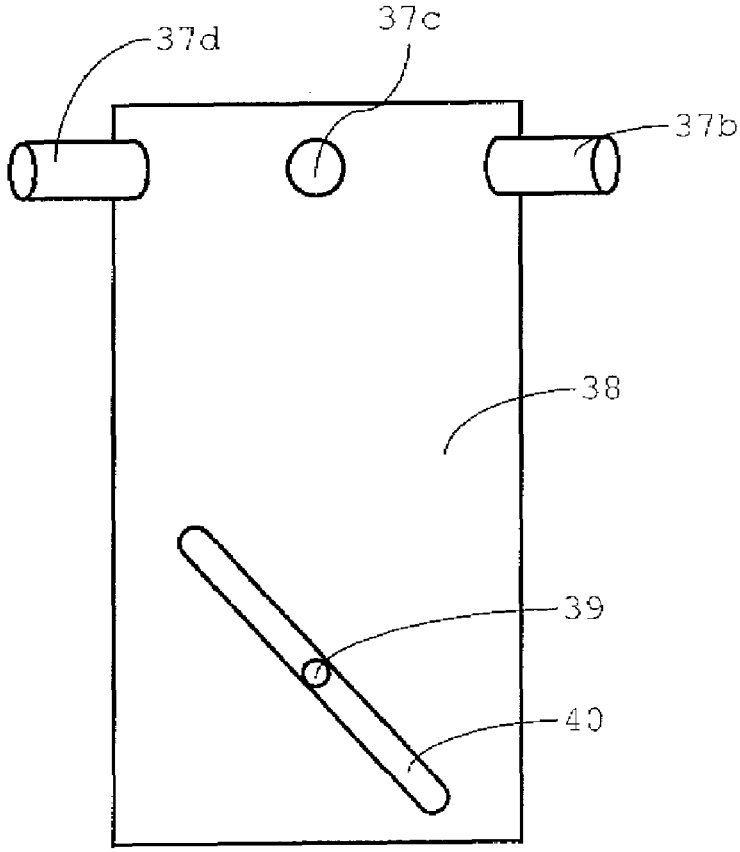
FIG. 8 is a schematic view in side-elevation of the second component of FIG. 7.
Figure 9:
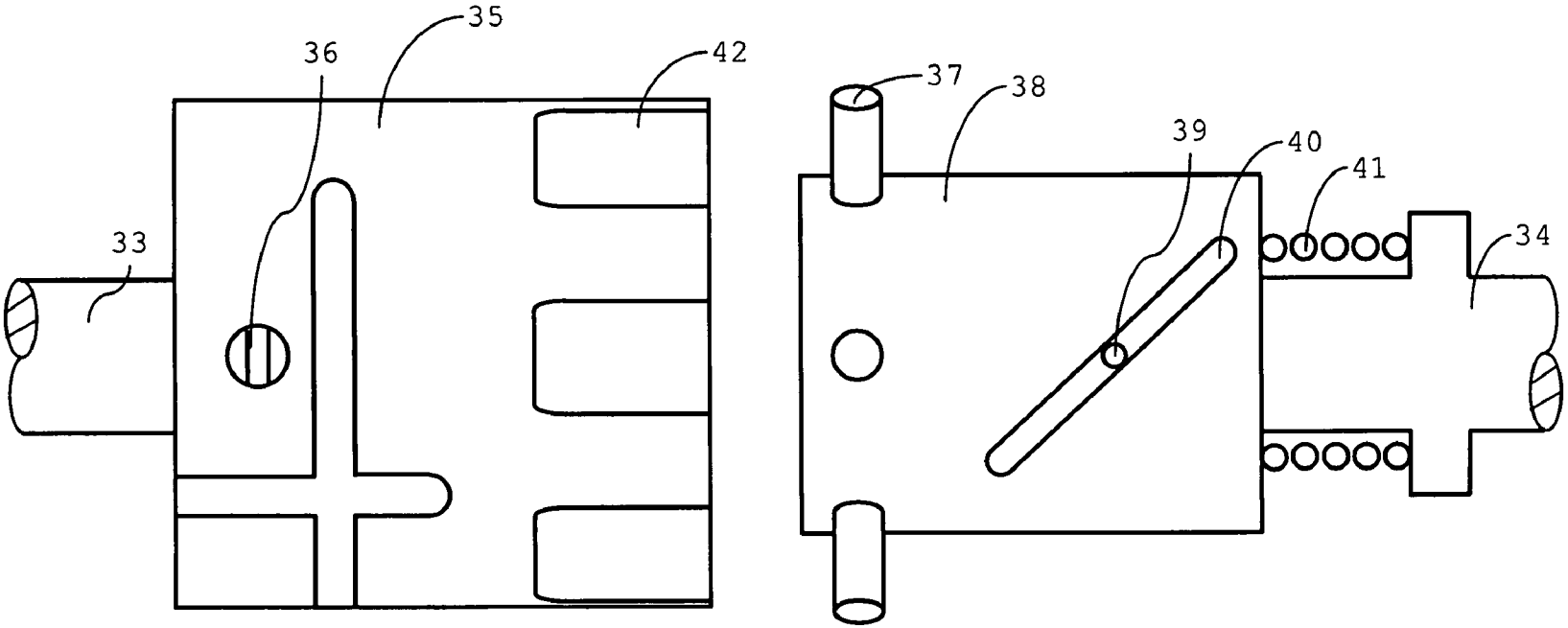
FIG. 9 is a schematic view in side-elevation of the assembly of first and second components of FIG. 5 and FIG. 7 in a configuration prior to engagement.

In FIGS. 3 and 4, a first interface is illustrated. A cartridge housing 19 is accommodated at a pre-determined position relative to a frame 20 of a printer housing. Pins (not shown)

provided adjacent electrical connectors 21,22 provided on the cartridge housing 19 and frame 20 form part of a guide mechanism for ensuring that the cartridge housing 19 assumes the pre-determined position when placed in the printer housing.

A cylindrical hollow shaft 23 accommodates a first rotatable shaft 24. The first rotatable shaft 24 protrudes from an end of the cylindrical hollow shaft 23. The first rotatable shaft 24 is supported by bearings 25,26 comprised in the cartridge. The rotatable shaft 24 is provided with a gear 27, which engages a gear (not shown in detail) of a machine provided in the cartridge. At a protruding end, the first rotatable shaft 24 is provided with a shape tapering towards the end. Thus, the first rotatable shaft 24 forms a further part of the guide mechanism for ensuring that the cartridge housing 19 assumes the pre-determined position when placed in the printer housing.

An electric motor 28 is attached to the frame 20. The electric motor 28 drives a second shaft 29 via a pulley 30. A double plate coupling 31 is affixed to an end of the second shaft 29, and supports a one-way clutch 32.

The double plate coupling 31 is a flexible coupling, in that it includes two plates linked by an elastomeric element (not shown). Although the first and second shafts 24,29 are brought into general axial alignment by means of the interlocking components provided adjacent the electrical connectors 21,22 and by the tapered end of the first rotatable shaft 24, slight misalignments are compensated for by means of the double plate coupling 31. In other embodiments, a different type of flexible coupling is used. Examples include bellows.

The one-way clutch 32 is configured to clamp a protruding part of the first rotatable shaft 24 accommodated within it. The one-way clutch 32 is of a suitable design including a resilient element like a torsion spring, arranged to accumulate energy when the second rotatable shaft is caused to rotate in one sense. Cessation of rotation in that one sense causes the torsion spring to relax, freeing the protruding part of the first rotatable shaft 24. The latter is thus free to be retracted when the cartridge housing 19 is removed from its pre-determined position of operation. Tensioning of the torsion spring, on the other hand, causes it to tighten around the protruding part of the first rotatable shaft 24, thus establishing a lock between the first and second rotatable shafts 24,29. Thus, the mechanism for providing the lock is actuated by transfer of rotary energy from the second rotatable shaft to the one-way coupling to effect establishment of the lock.

Components of a second type of interface between a first rotatable shaft 33 and a second rotatable shaft 34 (FIG. 9) are illustrated in FIGS. 5-9. In the following, it will be assumed that the first rotatable shaft 33 is supported by bearings in a replaceable cartridge, and that the second rotatable shaft 34 is supported by bearings of a housing for accommodating the cartridge in a pre-determined position relative to the housing. In other embodiments, the reverse may be the case.

A castellated cylinder 35 is configured for attachment to the first rotatable shaft 33, by means of a bolt 36. In other embodiments, bonding or welding is used as the means of attachment. Alternatively, a crown could be machined onto the first rotatable shaft 33.

The crown provided on the castellated cylinder 35 interlocks with pins 37 on a pin-bearing cylinder 38. A dowel 39 in an angled slot 40 provides a connection between the pin-bearing cylinder 38 and a part fixed on or integral with the second rotatable shaft 34. Thus, the pin-bearing cylinder 38 is moveable with respect to bearings supporting the second rotatable shaft 34. Movement is restricted to rotation and to a direction generally aligned with the axis of rotation of the second rotatable shaft 34, and the extent of movement is limited by the slot 40.

Resilient means in the form of a spring 41 are provided to urge the pin-bearing cylinder 38 towards the castellated cylinder 35. Due to the angle made by the slot 40 with respect to the axis of rotation of the pin-bearing cylinder 38, the latter rotates, allowing the pins 37 to find slots 42 in the crown. The spring 41 is compressed by the action of inserting the cartridge into the housing, where the pins 37 are not immediately aligned with the slots 42. In that state, the cartridge is in the pre-determined position and the first and second rotatable shafts 33,34 are rotatable with respect to each other. The lock between the pin-bearing cylinder 38 and the castellated cylinder 35 is releasable with the cartridge in its pre-determined position of operation, because the pin-bearing cylinder is freely movable, at least to an extent limited by the slot 40, in axial direction.

The invention is not limited to the described and illustrated embodiments, which may be varied within the scope of the accompanying claims. For example, the apparatus for driving a machine in a replaceable cartridge is not limited to use in conjunction with cartridges for printing apparatus. It can be used in other situations where transfer of rotary motion to a machine in a replaceable cartridge is required and a soft start is not possible or desirable.

The invention claimed is:

1. Apparatus for driving a machine in a replaceable cartridge, the cartridge supporting a first rotatable element for transferring rotary motion to the machine, wherein the apparatus includes:

a housing for accommodating the cartridge at a pre-determined position;

a second rotatable element, supported in the housing; and a locking mechanism, including a component, provided on a certain one of the first and second rotatable elements, and capable of assuming a state of readiness in which, with the cartridge at the pre-determined position, the component is positioned relative to the other of the rotatable elements such that, upon rotation of the second rotatable element in at least a first direction, the first rotatable element rotates with the second rotatable element, and in which state the first and second rotatable elements are axially decoupled, wherein the certain one of the first and second rotatable elements is provided with a resilient means for exerting a torque on the component tending to establish the state of readiness without rotating any of the first rotatable element and the second rotatable element.

2. Apparatus according to claim 1, wherein the locking mechanism is arranged such that the first rotatable element rotates with the second rotatable element only upon rotation of the second rotatable element in one of two opposite senses.

3. Apparatus according to claim 1, wherein the resilient means is arranged to exert a force providing the torque.

4. Apparatus according to claim 3, wherein the resilient means is arranged to store energy upon rotation of one of the first and second rotatable elements in one sense, and to exert a force on the mechanism for providing the lock tending to effect one of engagement and release of the lock.

5. Apparatus according to claim 1, wherein the locking mechanism is actuated by transfer of rotary energy from the second rotatable element to effect at least one of establishment and release of the lock.

6. Apparatus according to claim 1, wherein the locking mechanism includes a part, coupled to a shaft of one of the first and second rotatable elements by means of a flexible coupling, and arranged to engage a part of the other of the first and second rotatable elements.

7. Apparatus according to claim 1, wherein the first rotatable element includes a shaft protruding from the cartridge and the component of the locking mechanism is connected to the second rotatable element and arranged to clamp the shaft.

8. Apparatus according to claim 1, wherein the locking mechanism includes mutually interlocking parts, wherein a first of the mutually interlocking parts is provided on the component of the locking mechanism, and the other of the first and second rotatable elements is provided with a second of the mutually interlocking parts.

9. Apparatus according to claim 8, wherein the component of the locking mechanism is moveable, at least to a limited extent, in an axial direction relative to the one of the first and second rotatable elements.

10. Apparatus according to claim 8, wherein the mechanism for exerting a torque is arranged to cause at least the first of the interlocking parts to rotate with respect to the certain one of the rotatable elements, at least when disengaged from the second of the mutually interlocking parts.

11. Apparatus according to claim 1, wherein the torque tends to establish the state of readiness by rotating at least a part of the component relative to the certain one of the first and second rotatable elements.

12. Method of driving a machine in a replaceable cartridge supporting a first rotatable element for driving the machine, which method includes:

providing a housing for accommodating the cartridge at a pre-determined position, the housing including a second rotatable element, wherein a component of a locking mechanism is provided on one of the first and second rotatable elements; and placing the component in a state of readiness, in which state the component is positioned relative to the other of the rotatable elements such that, upon rotation of the second rotatable element in at least a first direction, the first rotatable element rotates with the second rotatable element, and in which state the first and second rotatable elements are axially decoupled, wherein the component is placed in the state of readiness by rotating at least a part of the component relative to the one of the first and second rotatable elements without rotating any of the first and second rotatable elements.

13. Method according to claim 12, wherein the component is caused to engage the other of the first and second rotatable elements such as to cause the first rotatable element to rotate with the second rotatable element by exerting a torque on the component of the locking mechanism through the second rotatable element.

14. Method according to claim 12, including storing energy in resilient means, connected to the one of the first and second rotatable elements, wherein the rotation of at least a part of the component of the locking mechanism relative to the one of the first and second rotatable elements is driven by the resilient means.

15. Method according to claim 12, wherein the component of the locking mechanism is caused to clamp a shaft of the first rotatable element protruding from the cartridge to enable the first rotatable element to rotate with the second rotatable element.

16. Method according to claim 12, wherein the component of the locking mechanism is placed in the state of readiness by causing mutually interlocking parts, provided on the component of the locking mechanism and the other of the first and second rotatable elements respectively, to engage.

17. Method according to claim 12, wherein the component of the locking mechanism is placed in the state of readiness by moving at least the component of the locking mechanism in an axial direction relative to the one of the first and second rotatable elements.

18. Apparatus for driving a machine in a replaceable cartridge, the cartridge supporting a first rotatable element for transferring rotary motion to the machine. wherein the apparatus includes:

a housing for accommodating the cartridge at a pre-determined position;

a second rotatable element, supported in the housing; and a locking mechanism, including a component, provided on a certain one of the first and second rotatable elements, and capable of assuming a state of readiness in which, with the cartridge at the pre-determined position, the component is positioned such that, upon rotation of the second rotatable element, the first rotatable element rotates with the second rotatable element. and in which state the first and second rotatable elements are axially decoupled, and a spring provided on the certain one of the first and second rotatable elements and configured to exert a torque on the component to establish the state of readiness without rotating any of the first and second rotatable elements.

19. Apparatus according to claim 18, wherein the locking mechanism includes mutually interlocking parts, wherein a first of the mutually interlocking parts is provided on the component, and the other of the first and second rotatable elements is provided with a second of the mutually interlocking parts.

20. Apparatus according to claim 19, wherein the component is moveable, at least to a limited extent, in an axial direction relative to the one of the first and second rotatable elements.

21. Apparatus according to claim 20, wherein the component rotates responsive to the movement in the axial direction.

22. Apparatus according to claim 19, wherein the component is a pin-bearing cylinder, and wherein the first mutually interlocking part includes pins protruding radially from an outer surface of the pin-bearing cylinder.

23. Apparatus according to claim 22, wherein the second mutually interlocking part is a castellated cylinder having slots engageable with the pins.

24. Apparatus according to claim 23, wherein the castellated cylinder is fixed to the other of the first and second rotatable elements.

25. Apparatus according to claim 22, wherein the pin-bearing cylinder includes an angled slot engageable with a dowel protruding radially from an outer surface of the certain one of the first and second rotatable elements.

26. Apparatus according to claim 19, wherein the mechanism for exerting a torque is arranged to cause at least the first of the interlocking parts to rotate with respect to the certain one of the rotatable elements, at least when disengaged from the second of the mutually interlocking parts.

27. Apparatus according to claim 18, wherein the torque establishes the state of readiness by rotating at least a part of the component relative to the certain one of the first and second rotatable elements.

28. Apparatus for driving a machine in a replaceable cartridge, the cartridge supporting a first rotatable element for transferring rotary motion to the machine, wherein the apparatus includes:

a housing for accommodating the cartridge at a pre-determined position;

a second rotatable element, supported in the housing;

a locking mechanism, including a pin-bearing cylinder having an angled slot engageable with a dowel protruding radially from an outer surface of a certain one of the first and second rotatable elements, provided on the certain one of the rotatable elements, and capable of assuming a state of readiness in which, with the cartridge at the pre-determined position, the cylinder engages an interlocking part on the other of the rotatable elements such that, upon rotation of the second rotatable element, the first rotatable element rotates with the second rotatable element, and in which state the first and second rotatable elements are axially decoupled, and a spring provided on the certain one of the rotatable elements and configured to exert a torque on the cylinder to establish the state of readiness.

* * * * *

UNITED STATES PATENT AND TRADEMARK OFFICE

CERTIFICATE OF CORRECTION

PATENT NO. : 7,680,437 B2
APPLICATION NO. : 11/740741
DATED : March 16, 2010
INVENTOR(S) : Avner Schneider et al.

It is certified that error appears in the above-identified patent and that said Letters Patent is hereby corrected as shown below:

In the drawings:

On Sheet 1 of 5, in Figure 1, delete " 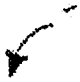 " and insert -- 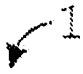 --, therefor.

In column 8, line 8, in Claim 18, delete "machine." and insert -- machine, --, therefor.

In column 8, line 19, in Claim 18, delete "element." and insert -- element, --, therefor.

Signed and Sealed this

Twentieth Day of July, 2010

David J. Kappos

David J. Kappos
*Director of the United States Patent and Trademark Office*